United States Patent [19]

Ling et al.

[11] Patent Number: 4,978,231

[45] Date of Patent: Dec. 18, 1990

[54] MULTIPLE DISPOSABLE PLASTIC BAG ASSEMBLY

[76] Inventors: Zhang A. Ling, No. 80, Yu Qun Rd. Wu Feng Xian, Taichung Xian; Wang C. Han, No. 11, Lane 300, Tun Shen Rd., Taichung, both of Taiwan

[21] Appl. No.: 314,786

[22] Filed: Feb. 24, 1989

[51] Int. Cl.[5] ..... B65D 25/16

[52] U.S. Cl. ..... 383/11; 383/33; 383/37; 383/103; 206/554; 220/403; 220/404; 220/407

[58] Field of Search ..... 383/11, 32, 33, 37, 383/103; 206/554; 220/406, 407, 404, 403

[56] References Cited

U.S. PATENT DOCUMENTS

| | | | |
|---|---|---|---|
| 1,181,506 | 5/1916 | Cunningham | 383/11 |
| 2,092,969 | 9/1937 | Gustafson | 220/404 |
| 2,324,440 | 7/1943 | Tormohlen | 220/404 |
| 2,861,735 | 11/1958 | Faltin | 383/11 |
| 3,128,904 | 4/1964 | Reilly | 220/407 |
| 3,510,052 | 5/1970 | Ruda | 383/11 |
| 3,512,338 | 5/1970 | Nestler | 220/407 |
| 3,546,327 | 12/1970 | Ruda | 383/103 |
| 4,139,037 | 2/1979 | McGuigan | 383/11 |
| 4,417,669 | 11/1983 | Knowles et al. | 206/554 |
| 4,502,599 | 3/1985 | Perecman | 383/32 |
| 4,595,389 | 6/1986 | Lehmacher | 383/37 |
| 4,610,358 | 9/1986 | Walter | 220/407 |
| 4,715,572 | 12/1987 | Robbins, III et al. | 220/404 |
| 4,724,955 | 2/1988 | Martin et al. | 220/403 |
| 4,747,701 | 5/1988 | Perkins | 383/33 |
| 4,823,979 | 4/1989 | Clark, Jr. | 220/1 T |
| 4,860,916 | 8/1989 | Winters | 220/403 X |
| 4,869,391 | 9/1989 | Farrington | 220/403 X |

FOREIGN PATENT DOCUMENTS

| | | | |
|---|---|---|---|
| 2710150 | 9/1978 | Fed. Rep. of Germany | 206/554 |

*Primary Examiner*—Stephen Marcus
*Assistant Examiner*—Jes F. Pascua
*Attorney, Agent, or Firm*—Fleit, Jacobson, Cohn, Price, Holman & Stern

[57] ABSTRACT

A multiple disposable plastic bag assembly comprised of multiple disposable plastic bags nested one within another to form a bag assembly, characterized in that sticking elements are made on the circular top edge of the opening of the bag body for sticking of the bag assembly to a wastebin to allow the disposable plastic bag assembly to be torn up consecutively bag by bag so as to minimize time consumption in placing individual bags in a wastebin and to facilitate packing up garbage within a bag of the assembly.

4 Claims, 2 Drawing Sheets

MULTIPLE DISPOSABLE PLASTIC BAG ASSEMBLY

BACKGROUND OF THE INVENTION

The present invention relates to a disposable plastic bag and, more particularly to a multiple disposable plastic bag assembly for convenient garbage collection.

Conventionally, a garbage bag placed in a wastebin is used for convenient collection of garbage. Regular garbage bags are of a single layer type disposable plastic bags. When placing a disposable plastic bag in a wastebin, the bag is opened and the top circular edge of the bag is turned inside out to hang on the top circular edge of the wastebin so as to let the opened bag body be firmly positioned in the wastebin, and to facilitate packaging after having been fully filled with garbage. However, conventional single layer disposable plastic bags are not convenient to use. Because each time after a bag which is fully filled with garbage is thrown away, another one has to be placed in the wastebin. The process to place a disposable plastic bag in a wastebin has therefore to be repeated again. If there are ten or several tens of wastebins used in an office, it will become a big burden to a cleaner because it would take a lot of time and exertion to repeatedly collect the bags and replace new bags each day. It has been proposed before to place several disposable plastic bags in a wastebin at a time to avoid repeated placing of a new plastic bag in a wastebin after the previous one is collected. However, this has not been practical an has caused new problems. According to this method, a plurality of disposable plastic bags are seperately placed in a wastebin one after another. This process is cumbersome. When a plurality of disposable plastic bags are arranged in a wastebin with one nested in another, the air stored up among the laminated bags must be expelled from the bags otherwise the available collection space will be reduced. However, it is still time consuming to expel the air from the bags. Further, because all the bags are placed in a wastebin with the top circular edge turned inside out to hang on the top circular edge of the wastebin, when it is required to pick up the inner one from the nested bags to package the garbage, it is very difficult to separate the inner bag from the others, and several plastic bags may be drawn up at a time to create further problems. In order to solve the said problems, it is an object of the present invention to provide a multilayer disposable plastic bag assembly which alleviates the abovementioned difficulties.

SUMMARY OF THE INVENTION

The main object of the present invention is to provide a multiple disposable plastic bag assembly which is easy to place in a wastebin and is repeatedly used by tearing up one bag after another to reduce the time and effort required in the arrangement of disposable plastic bags in a wastebin and to increase the efficiency in handling garbage.

Another object of the present invention is to provide a multiple disposable plastic bag assembly to facilitate packing up garbage and to render garbage handling easier.

According to the present invention, a multiple disposable plastic bag assembly is comprised of two or more disposable plastic bags having respectively a collection space and an opening. The bag assembly is characterized in that two opposite connections which are separately made on the top side edge of said opening to let all of said plastic bags be connected together. A sticking element is respectively made on the outer side of each of the two connections for sticking the top circular edge of the plastic bag assembly to the top circular edge of a wastebin. A perforated line is respectively made along the periphery of each of the connections from the top edge of the opening of the bag body to surround the associated sticking element thereinside. A plurality of fine air holes are made on the side surface of the bag body at the middle portion thereof.

The above and other objects, features and advantages of the present invention will be fully understood from the following description considered in connection with the accompanying drawings as hereunder.

DETAILED DESCRIPTION OF THE PREFERRED EMBODIMENT

Figure 1:
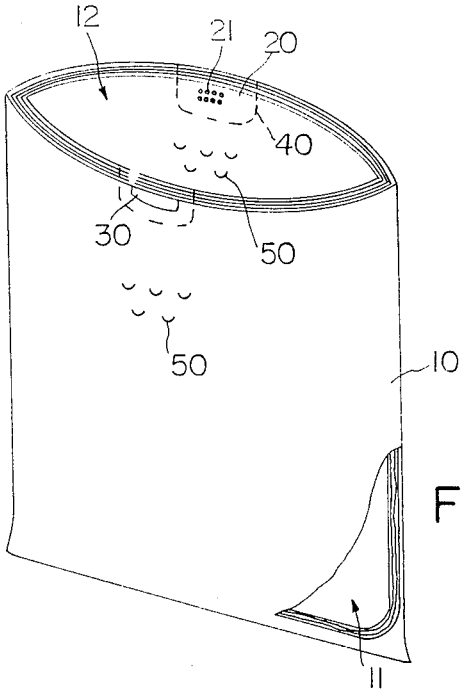
FIG. 1 is perspective view of a preferred embodiment constructed according to the present invention.
Figure 2:
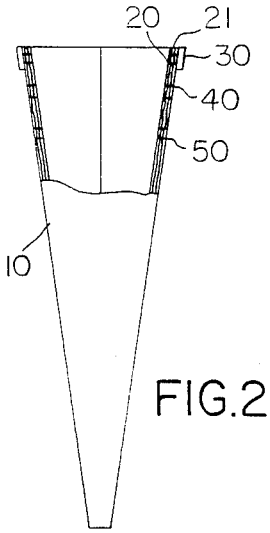
FIG. 2 is a sectional view of the said preferred embodiment of the present invention.

Referring to FIGS. 1 and 2, a multiple disposable plastic bag assembly includes a bag body (10) having two connections (20) separately made at the top edge with a sticking element (30) respectively made on the outer side on each one of the two connections (20), with a perforated line (40) respectively made to surround each connection (20), and with several air holes (50) made on both lateral sides of the bag body (10).

The bag body (10) is comprised of two or more disposable plastic bags with one nested in another. According to the present invention, the most preferable number of bags in the assembly is 8–12. The bag body (10) defines a collection space (11) on its inside, and it has an opening (12) at the top, so that garbage can be thrown into the collection space (11) from the opening (12) for storage therein. Two opposite connections (20) are separately made on the top side edge of the opening (12). The connections (20) are most preferably made by means of heat melting needles (not shown) to form a plurality of small holes (21). By means of the high temperature carried from the heat melting needles during penetration through the bag body (10) to form a plurality of small holes (21), all the disposable plastic bags of the multiple disposable plastic bag assembly are connected together by means of a melt connection. A sticking element (30) made of double-sided adhesive cellophane tape or the like is attached to the outer side of each of the two connections (20) for further positioning of the bag assembly when it is placed in a wastebin. A U-shaped perforated line (40) is made along the periphery of each connection (20) from the top edge of the opening (12) of the bag body (10) so as to surround the associated sticking element (30) thereinside. The perforated line (40) is provided through all the bags of the assembly to facilitate tearing up each plastic bag from the bag assembly through the perforated lines (40). In order to facilitate the separation process, the connecting points of each perforated line (40) is made only at the top edge of the opening and the turning corners. The two opposite large surfaces of the bag body (10) are provided with a plurality of fine air holes (50) to prevent air collection between the wastebin and the bag body (10) so as to facilitate placing of the bag assembly in a wastebin. The fine air holes (50) are in the form of arcuate slits (as shown in FIG. 1) piercing process to form in a semi-closed condition as shown, so as to provide an isolation effect while allowing the passage of the air therethrough.

Figure 3:
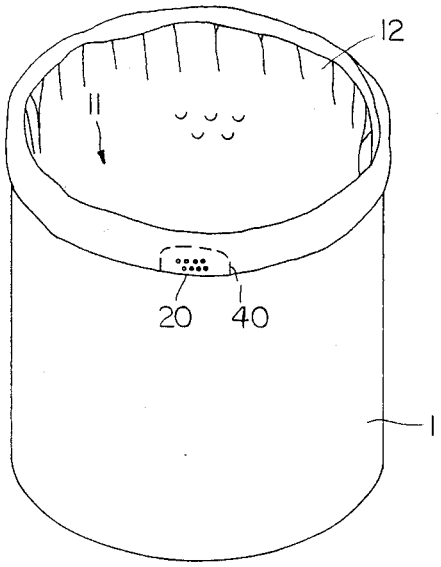
FIG. 3 is a schematic drawing of the said preferred embodiment located in a wastebin.
Figure 4:
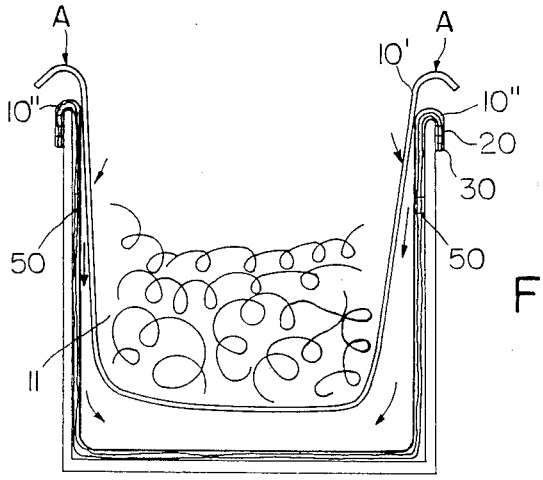
FIG. 4 is a schematic sectional view drawing of the said preferred embodiment, illustrating the process to tear up the bag assembly bag by bag.

The features and advantages of the present bag assembly will become more apparent when matching with a wastebin for use. Referring to FIGS. 3 and 4, the collection space (11) of the bag body (10) is opened and placed in a wastebin (1) with the opening (12) of the bag body (10) turned inside out to cover the circular edge of the wastebin (1), allowing the doublesided adhesive cellophane tape of the sticking element (30) to be firmly stuck to the outer side of the top circular edge of the wastebin (1). Thus, the bag body (10) is firmly positioned in the wastebin (1).

When the collection space (11) of the bag body (10) is fully filled with garbage, it is not necessary to place a new plastic bag in the wastebin after packing up the garbage with the bag body. In the present invention, when the collection space (11) of the bag body (10) is fully filled with garbage, layer of the top layer of plastic bag (10)′ is seized with the fingers of both hands by the turned over portion (A) of opening (12) at the opposite sets of perforated lines (40) and then, the top plastic bag (10)′ is pulled out from the wastebin (1). At this moment, the garbage filled top plastic bag (10)′ is placed under tension due to the gravity of the garbage so as to allow easy separation from the other plastic bags (10)″. When the top plastic bag (10)′ is pulled upward, the pulling force causes the top plastic bag (10)′ to be torn from the two opposite connections (20) through the respective perforated lines (40) with the rest of the plastic bags (10)″ remaining in the wastebin (1) in the right position. By means of this arrangement, the repeated consumption of time and effort in placing new plastic bags is minimized. According to the present invention, the bag body (10) is torn up bag by bag for repeated application until the last bag is used. In comparison with conventional single disposable plastic bags, the present invention can relatively reduce by ⅞ to 11/12 the time and exertion in handling garbage. Therefore, high efficiency is achieved in the present invention.

Figure 5:
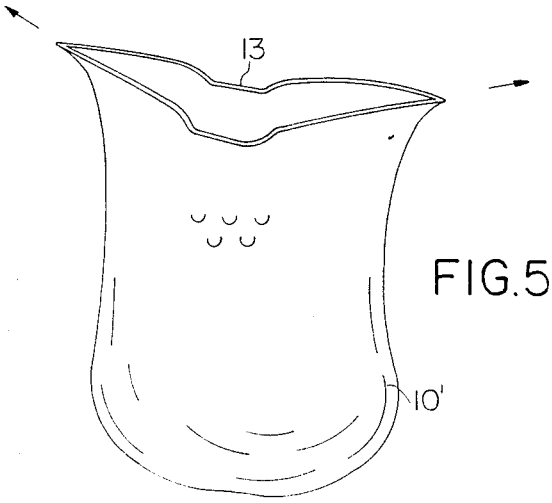
FIG. 5 illustrates a single plastic bag which has been removed from the said preferred embodiment.

Referring to FIG. 5, when the top plastic bag (10)′ is fully filled with garbage and is pulled out of the bag assembly from the opposite two sticking elements (30) along the opposite two sets of perforated lines (40), two opposite indentions (13) are formed at both sides at the top of the opening (12) to facilitate outward extension of the opening (12) such that both ends of the opening (12) may be easily pulled to extend outward to facilitate packing up the garbage with the bag. When the garbage is packed up, the inner air may be squeezed out through the fine air holes (50) to minimize the space of the garbage and to reduce space consumption when the garbage bag is put in a garbage truck.

The multiple disposable plastic bag assembly of the present invention is arranged in a ready condition for immediate placing in a wastebin in the most efficient way for ready application. A consumer may just stick the bag assembly to a wastebin in a single operation, the bag assembly being provided for repeated service. The production of the present invention is also very simple and may be made by means of integrated production process to minimize the manufacturing cost. The continuous output of single layer plastic bags made through shape blowing process is treated by a v cuum suction process to let the opening of the plastic bags be opened. The opened plastic bags are further delivered through a conveyer, to be mounted on a bracket one after another. As soon as a fixed number of plastic bags are mounted into a nested bag assembly, it is removed from the bracket for receiving further needle heat melting treatment and to be subjected to a perforated line forming process. This manufacturing process is quite simple and well known, and is not part of the present invention.

In general, the present invention provides a multiple disposable plastic bag assembly having numerous features each of which tends to make the structure more practical and more convenient in use, as described and defined by the claims.

We claim:

1. A multiple disposable plastic bag assembly including a bag body of two or more plastic bags nested one inside another, said bag body comprising a collection space and an opening; characterized in that two opposite connections are separately made on the top side edge of said opening to connect together all bags of said plastic bag assembly, a sticking element being respectively provided on the outermost bag of said plastic bag assembly at the location of each of said connections for sticking the top circular edge of said plastic bag assembly to the top circular edge of a wastebin, a perforated line being respectively made through all bags of the plastic bag assembly along the periphery of each of said two opposite connections from the top edge of said opening of said bag body to surround the associated connections thereinside, a plurality of fine air holes being made on a side surface at a middle portion of said bag body.

2. A multiple disposable plastic bag assembly according to claim 1, wherein said two connections are made by penetrating heat melting needles through said bag body to form a plurality of small holes so that between each of the bags of the plastic bag assembly a melted connection is formed.

3. A multiple disposable plastic bag assembly according to claim 1, wherein said two sticking elements are made of a double-sided adhesive cellophane tape respectively attached to the outermost bag of said plastic bag assembly at the location of said two connections.

4. A multiple disposable plastic bag assembly according to claim 1, wherein each of said perforated lines is made in a U-shape.

* * * * *